United States Patent [19]

Baumann

[11] 3,979,825

[45] Sept. 14, 1976

[54] HAIR CUTTING AND TRIMMING DEVICE

[76] Inventor: John Hoegh Baumann, 38 Lakeview Ave., Kingston, Ontario, Canada

[22] Filed: Oct. 17, 1975

[21] Appl. No.: 623,318

[52] U.S. Cl. ..... 30/133; 30/201
[51] Int. Cl.[2] ..... B26B 19/20; B26B 19/44
[58] Field of Search ..... 30/133, 201, 202

[56] References Cited

UNITED STATES PATENTS

| | | | |
|---|---|---|---|
| 1,238,061 | 8/1917 | Bourdelat | 30/133 |
| 1,331,218 | 2/1920 | Severson | 30/133 |
| 1,404,798 | 1/1922 | Severson | 30/133X |
| 1,423,363 | 7/1922 | Severson | 30/133 X |
| 3,260,268 | 7/1966 | Reynolds | 30/133 X |
| 3,273,237 | 9/1966 | Barcaskey | 30/133 |
| 3,654,699 | 4/1972 | Garcia | 30/133 |

*Primary Examiner*—Al Lawrence Smith
*Assistant Examiner*—J. C. Peters

[57] ABSTRACT

A hair cutting and trimming device having an electrically operated clipper enclosed in an elongated housing, distance between the cutting teeth of the clipper and the hair intake end of the device being selectively variable to permit cutting hair to varying lengths to suit modern styles of haircuts, air suction means being incorporated at the closed end of the housing to draw hair through the open end of the housing toward the cutting end of the clipper and to remove the clippings. Hair guide deflector means are incorporated to ensure that all hair that reaches the cutting end, will pass between the teeth of the cutter and be cut. Control means controlling movement of the clipper relative to the open end of the housing ar incorporated, providing countable increments of motion to permit accurate styling of haircut during the haircutting operation. Programming means are incorporated to permit styling to preselected patterns on hair styling maps containing length indications on various portions of the maps to correspond with length markings on the selectively variable distance means on the device.

7 Claims, 17 Drawing Figures

HAIR CUTTING AND TRIMMING DEVICE

This invention relates to a device for cutting and trimming hair and more particularly to hair cutting devices utilizing powered clippers of the class including attachment to a vacuum cleaner or other suction means and incorporates improvements that ensure that all hair that reaches the cutting teeth of the powered clippers does become cut and also permits the hair cutting device to be utilized in styling haircuts to modern long styles in conjunction with haircut maps indicating scalp zones with varying length of hair.

A number of hair cutting and hair trimming devices, utilizing vacuum means, having previously been proposed but have not proved to be practicable.

U.S. Pat. No. 3,654,699 shows a hair trimming device that is usable for hair trimming only since hair of any appreciable length would be drawn in around the hair clipper as suction is concentrated not just at the cutting teeth portion but all around the clipper, thereby allowing only a small portion of longer hair to be cut if any at all. Range of length of hair is limited to very small adjustment by use of the disclosed helical slot which would break vacuum if extended to distances required by modern hair styles.

U.S. Pat. No. 3,230,619 shows a hair cutting apparatus that utilizes a hollow, pressurized extendable comb that may be extened in front of the clipper to a required distance corresponding to length of hair to be cut, which in conjunction with a suction nozzle behind the cutting teeth is claimed to position hair toward the cutting teeth. As distance between hollow comb and cutting teeth increases, a major portion of the airstream is lost to surrounding air and accompanying loss of efficiency and accuracy in extending hair toward the cutting teeth.

To my knowledge, none of the prior art includes means for providing sufficient suction to ensure that the major portion of the hair on the scalp near the intake end of the device gets drawn into the device and gets cut by the cutting teeth.

None of the prior art includes means for controlably varying the length of the cut hair from very short lengths, for instance for trimming around the temples of the head to progressively longer hair of a length of for instance 10 inches of longer, progressively as the hair cutting device is moved over the head, with the hair intake end constantly in contact with the scalp of the person whose hair is being cut.

It is an object of this invention to provide a hair cutting and hair trimming device that may be easily utilized by an unskilled operator.

It is another object of this invention to provide a device that may be selectively adjusted to trim hair to a short length as well as to cut hair to the longer varying lengths that are required by the longer hair styles of today.

It is a further object to provide a device that incorporates an open hair intake end and includes a closed passageway leading from the open intake end to the cutting area of the clippers, thereby to exclude ingress of extraneous, false air from the suction path, in order to maximise the suction on the portion of hair that is immediately to be cut.

It is a further object to provide a device in which the air flow from the suction means is directed through the teeth of the clipper and the area directly above the teeth, so that all hair, drawn in by the suction becomes concentrated directly above or through the teeth of the clipper.

It is a still further object to provide a device that incorporates hair deflector means in the air flow path, directly before and directly after the cutting teeth, thereby to provide that the air flow area through and above the cutting teeth may be large enough to provide unrestricted air flow, sufficient to act strongly enough to draw hair from the open intake end up to the cutting teeth, the hair deflectors forcing the hair towards the cutting teeth of the clipper and away from the non cutting air flow area above the teeth, in order to ensure that all hair that reaches the cutting end of the clipper, is cut.

It is another object to provide a device in which the cutting teeth of the clipper may be selectively located close to the intake end and incrementally moved from such close position to any selected position away from the open intake end, during the cutting operation, the operator merely activating a countable number of increments on the motion control mechanism as he moves the open intake end of the device over the scalp of the person whose hair is being cut.

It is still another object to provide a device with the above features, that may be easily utilized by an operator who is cutting the hair on his own head and wishes to style it at the same time.

It is a further object to provide a device in which the same suction means that draws the hair toward the cutting teeth also removes the hair that has been cut off and deposits it in a suitable container such as a vacuum cleaner bag, if a vacuum cleaner is utilized to provide the suction means, or a special collecting means, if the suction mechanism is located directly on the device.

It is a still further object to provide a device supplied with hair length indications permitting the device to be utilized in conjunction with hair styling maps containing a plurality of hair zones, each marked with corresponding hair lengths to constitute a specific style of a variety of hair styles.

In the drawings.

In the following description the same reference numeral is used throughout the various figures of the drawings to designate the same part.

Figure 1:
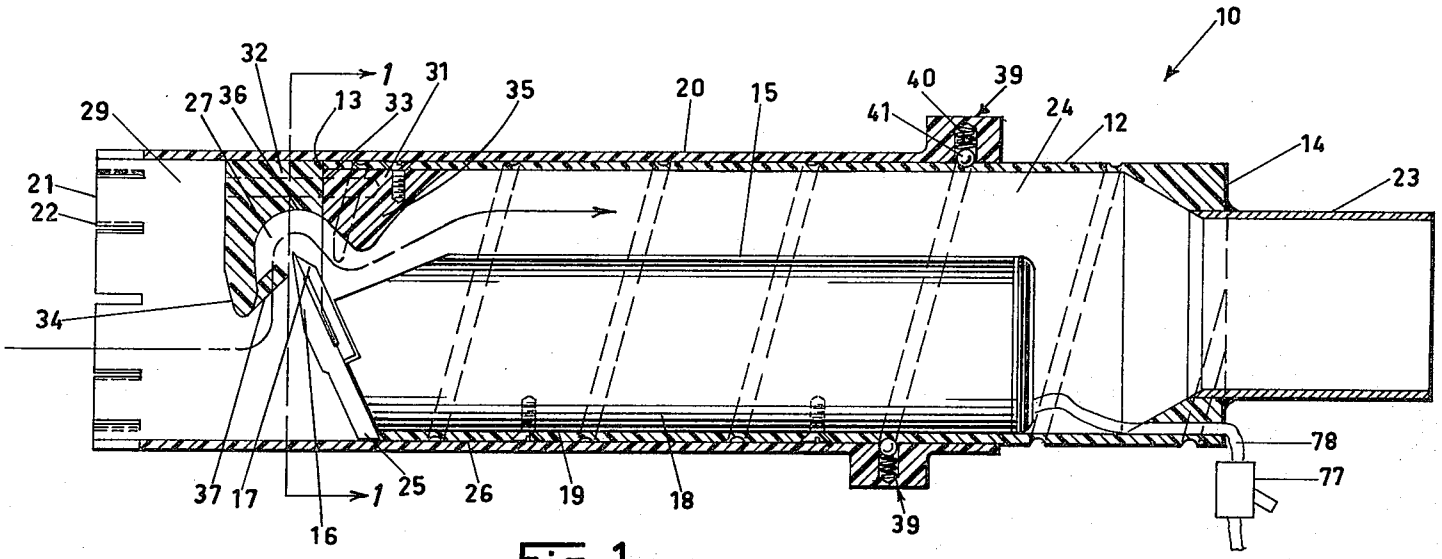
FIG. 1 is a mid-sectional, side elevation of one preferred embodiment of a device incorporating the principles of the present invention.

Referring to FIG. 1, a preferred embodiment of the hair cutting and trimming device, utilizing the present invention, is shown, generally indicated by the reference numeral 10, comprises a tubular housing 12, having in this case a circular cross-section, housing 12 having an open end 13 and an opposite closed end 14. A conventional motor driven hair clipper 15 of a type well known in the art, has a cutting end 16 supplied with cutting teeth 17, clipper 15 being located longitudinally within housing 12, base 18 of clipper 15 being firmly attached directly adjacent an inner wall 19 of housing 12, cutting teeth 17 extending slightly outside open end 13 to facilitate use as trimmer.

A telescoping, extendable tube 20 is located axially slidable on housing 12, extendable tube 20 having an open end 21 supplied with a plurality of vacuum breaking slots 22, to prevent suction within device 10 during operation thereof, from holding on to the scalp of the hair being cut, slots 22 being of sufficient width and length to permit easy movement of device 10 over the scalp, without any overt suction affect being felt, yet permitting sufficient suction to draw hair in through open end 21 to cutting teeth 17.

Closed end 14 of housing 12 is supplied with hose connection means 23 for attachment to a source of suction such as, for instance a vacuum cleaner hose which is connected to a vacuum cleaner to create a vacuum within cavity 24 of housing 12 and to provide suction means through open end 21 and slots 22, over and through cutting teeth 17 to draw hair during cutting operation toward cutting teeth 17 and to disperse cut hair ends through hose connection 23.

Referring to FIGS. 1, 2, 3, 4, and 5, cutting end 16 of clipper 15 is supplied with seal means 25 that fits closely against inner surface 26 of extendable tube 20, to prevent air stream, provided by suction in cavity 24, from passing cutting end 16 at any other location than through cutting teeth 17, or directly above cutting teeth 17 through channel 27.

In order to provide sufficient air flow through device 10 to ensure that even comparatively long hair is drawn in through open end 21 and up to teeth 17 to be cut, it is necessary to maintain a certain minimum of crossectional air passage area throughout device 10. Tooth spaces 28 in cutting end 16 are comparatively small and would by themselves only provide a comparatively small air passage area to pass through from open end 21 to cavity 24 and would therefor unduly restrict the air flow and suction power of the device to such an extent that there would not be sufficient suction to draw hair from a scalp toward cutting teeth 17, with sufficient strength to ensure cutting of hair to a desired length.

An air channel 27 has therefore been positioned around and above teeth 17 to increase open airflow area at the cutting teeth location, thereby increasing suction power within chamber 29, located at open end portion of extendable tube 20, to the point where the air flow provides sufficient suction to draw the free ends of all hair that may be situated at open end 21, through chamber 29 to cutting teeth 17 so they may be cut. Velocity of air flow past cutting teeth 17 is thereby also increased to facilitate drawing hair into teeth 17.

In order to prevent hair from simply becoming located in channel 27, being drawn thereinto by the air stream without being cut by cutting teeth 17, a hair deflector means 30 is attached within open end 13 of housing 12, hair deflector means 30 having a stationary portion 31 and a removably attachable portion 32, for example attached to stationary portion 31 by means of 2 frictionably insertable pins 33, movable portion 32 having a downwardly depending nose end 34 located a suitable distance in front of cutting end 16, a similar nose 35 depending downwards behind cutting teeth 17, internal profile 36 formed by hair deflector 30 forming a concave passageway over and around teeth 17, having sufficient cross-sectional area in conjunction with free area through teeth 17, to provide an air stream of sufficient strength through device 10 to draw hair fully up to cutting teeth 17.

Noses 34 and 35 provide sufficient mechanical deflection of any hair ends to reach cutting teeth 17, to for such hair ends into teeth 17 to be cut. It has been found during tests that the air stream, as it passes through channel 27 creates a turbulent vortex, that carries with it an undesirable sound. This turbulent vortex may be broken up by providing an inwardly facing tab 37 inside nose 34, tab 37 extending into channel 27 partway towards teeth 17, thereby eliminating the undesirable sound.

Housing 12 is supplied with a shallow external thread 38, extendable tube 20 being supplied with at least one detent means 39, comprising in this case, a spring 40, biasing a ball 41 in towards housing 12, ball 41 engaging in thread 38 and acting as nut means on thread 38 upon extendable tube 20 being rotated upon housing 12 to progress extendable tube free end 21 closer or further away from cutting teeth 17. Spring 40 is of suitable tension to permit forceable sliding of extendable tube 20 on housing 12, axially back and forth, to provide rapid axial adjustment as well as definite increments of adjustment equal to increments of pitch in thread 38.

Suitable measurement indications may be marked on housing 12 as shown at 42 to correspond with marker surfaces on tube 20 such as for instance rear edge 43, to indicate length of hair remaining on scalp after being cut at this particular adjustment.

An extra extension tube 44 may be detachably attached to open end 21 of extendable tube 20, to accommodate hair cuts requiring longer remaining hair lengths than extendable tube 20 will permit, extra extention tube 44 having an open end 45 and vacuum breaker slots 22 similar to those shown on open end of extendable tube 20.

Referring to FIGS. 6, 7, 8, 9, 10, 11, 12 and 13, a second preferred embodiment of the present invention is shown, comprising a tubular housing 50 having an open end 51 and an opposite closed end 52, closed end 52 being supplied with hose connection means 53 for attachment to a source of suction. Tubular housing 50 is in this instance shown as having a circular cross-section but could be of square cross-section or any other cross-section that could be of convenient design.

A plurality of incremently spaced shallow annular grooves 54 are located in the outer surface 55 of tubular housing 50. An extendable tube 56, has similar characteristics and purposes as extendable tube 20, shown in FIG. 1 and explained in the foregoing text. Extendable tube 56 contains at least one detent means 57 for co-operation with grooves 54 upon extendable tube 56 being extended or retracted upon tubular housing 50. In this case haircut lengths may be varied in steps equal to size of increments between annular grooves, whereas in device shown in FIG. 1, gradual variation as well as incremental variation in hair length may be accommodated.

Figure 4:
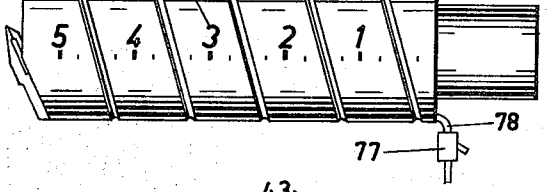
FIG. 4 is a somewhat reduced side elevation of the externally threaded, tubular housing of the device shown in FIG. 1 with the extendable tube and detachable hair guide portion removed to permit use of the device for trimming hair.
Figure 5:
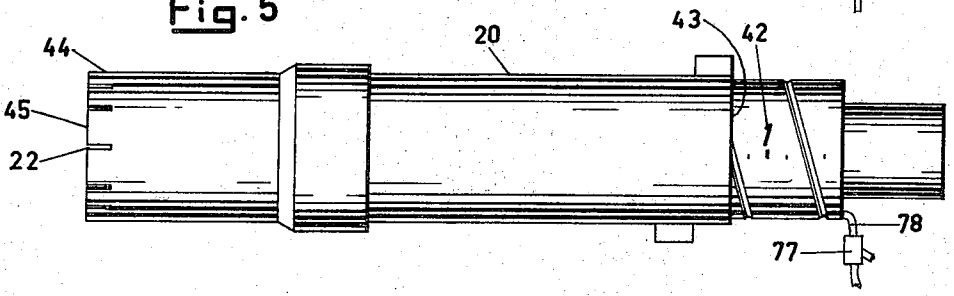
FIG. 5 is a somewhat reduced side elevation of the device shown in FIG. 1. showing an extra extension tube attached onto the extendable tube to permit cutting of hair to extra long lengths.
Figure 3:
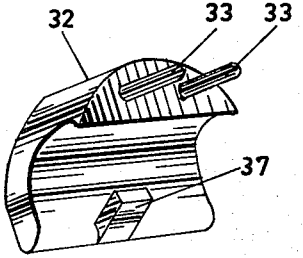
FIG. 3 is a perspective view of the detachable hair guide portion of the device shown in FIG. 1.
Figure 2:
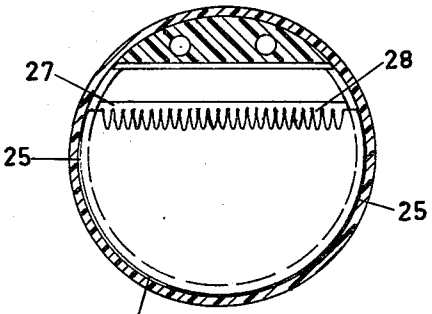
FIG. 2 is a cross-sectional, front elevation of the device shown in FIG. 1, taken on line 1-1.
Figures 6, 7, 8, 9, 10, 11, 12, 13:
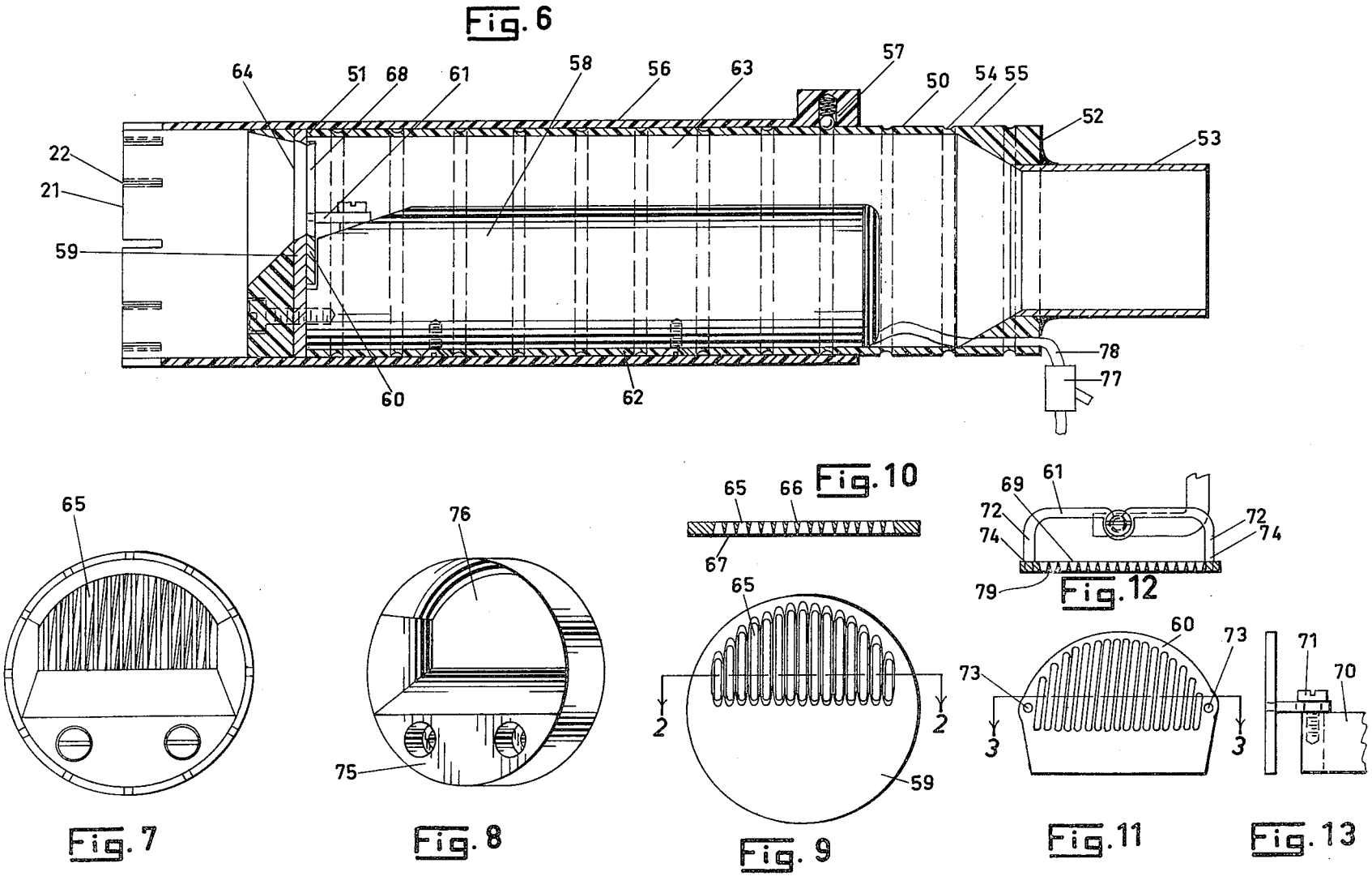
FIG. 6 is a mid-sectional side elevation of a second preferred embodiment of a device incorporating the present invention, utilizing slotted blades for cutting the hair and incrementally spaced annular grooves on the tubular housing of the device.
FIG. 7 is a front elevation of the device shown in FIG. 6, illustrating the oblique co-operation of the cutting slots in the cutting blades and positioning of the truncated hair guide plate over the cutting slots.
FIG. 8 is a perspective view of the hair guide plate of the device shown in FIG. 6.
FIG. 9 is a front elevation of the stationary cutting blade of the device shown in FIG. 6.
FIG. 10 is a cross-sectional, top view of the stationary blade shown in FIG. 9, taken on line 2-2.
FIG. 11 is a front elevation of the movable blade of the device shown in FIG. 6.
FIG. 12 is a cross-sectional view of the movable blade shown in FIG. 11, taken on line 3-3, illustrating the motion transfer and pressure biasing spring transferring reciprocating motion from motor driven cutter mechanism to the movable blade.
FIG. 13 is a side elevation of the movable blade and motion transfer spring shown in FIGS. 11 and 12, illustrating pivot pin attachment of the spring to movable anchor of the motor driven cutter.

Similar incremental measurement markings may be located on tubular housing 50 as shown on FIG. 4 at 42 to indicate length of cut hair at any time.

A motor driven hair clipper 58 of generally conventional type but modified to utilize a novel stationary blade 59 and a novel movable blade 60 that are specific to this invention together with novel pivoting drive spring means 61, is attached to one internal side 62 of housing 50, leaving a substantial free airstream area 63 within tubular housing 50 above clipper 58.

Stationary blade 59 covers open end 51 of tubular housing 50 completely and contains cutting area 64 located directly in path of air stream that progresses through area 63 during operation, cutting area 64 being supplied with a plurality of cutting slots 65 located substantially perpendicular to direction of movementl of movable blade 60. Slots 65 may be truncated movement have a smaller width at cutting surface 66 of blade 59 to provide cutting rake and to facilitate entry of hair into entry side 67 of blade 59.

Movable blade 60 contains a cutting area 68 corresponding substantially with cutting area 64 of stationary blade 59, movable blade 60 containing a plurality of cutting slots 69 that may be located at a somewhat oblique angle to cutting slots 65 of stationary blade 59, to provide shearing action on hair to be cut.

Slots 69 may also be truncated to have a smaller width at cutting surface 79, cutting surface 66 and cutting surface 79 being in intimate contact and biased toward each other during operation of the device.

A drive spring 61 is pivotally attached to drive anchor 70 of cutter 58 by shoulder screw 71, drive spring 61 having a forked configuration with the two tines 72 engaging partway into holes 73 in movable blade 60, tines 72 being supplied with shoulders 74 to permit spring tension in drive spring 61 to bias movable blade 60 toward stationary blade 59.

Anchor 70 will normally have an arcuate motion during operation of clipper 58, but pivoting of drive spring 61 on shoulder screw 71 will permit drive spring 61 to retain its relative position to movable blade 60 independent of arcuate motion of anchor 70.

A hair guide plate 75 is located in front of stationary blade 59, hair guide 75 being supplied with a truncated preforation 76, the smaller area of the truncated perforation being located directly over cutting area 64 in stationary blade 59, hairguide 75 being of sufficient thickness to guide hair ends, entering through open end 21 of extendable tube 56 into cutting slots 65 as air stream draws hair into device during operation thereof.

Suitable switch means 77 for operating cutter 58 may be located on housing 50 or on electric power cord 78 supplying current to clipper 58.

Figure 14:
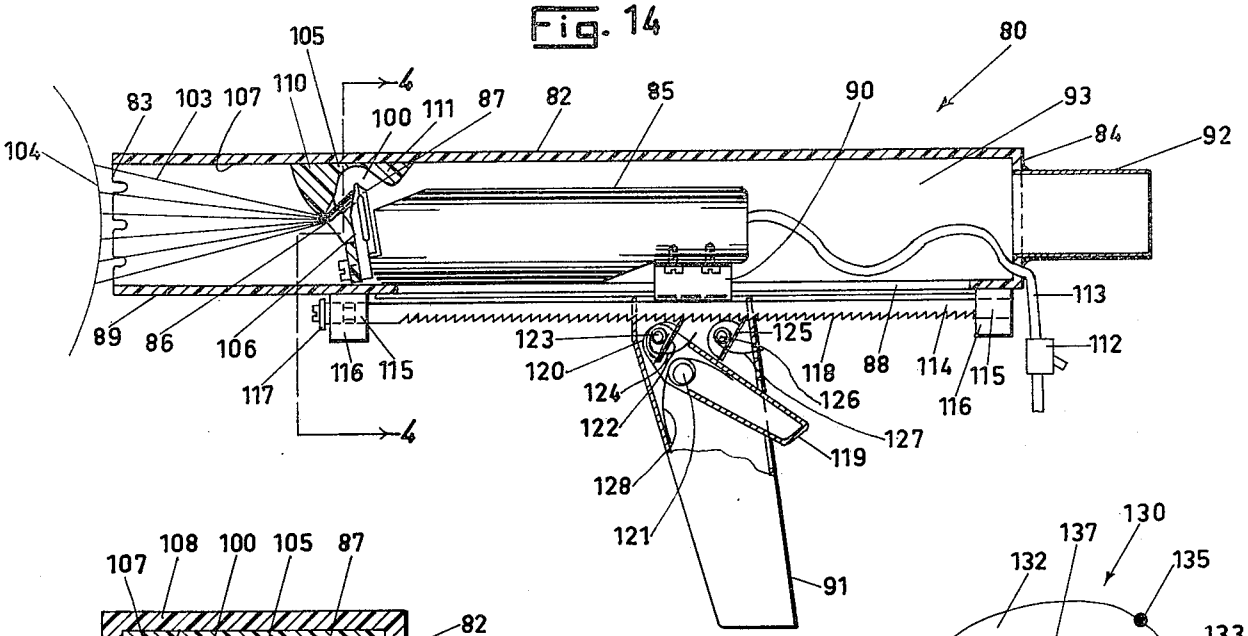
FIG. 14 is a mid-sectional, side elevation of a preferred third embodiment of a device incorporating the present invention illustrating particularly the ratchet rack system for varying the distance between the cutting teeth and the open end of the tubular housing.
Figure 15:
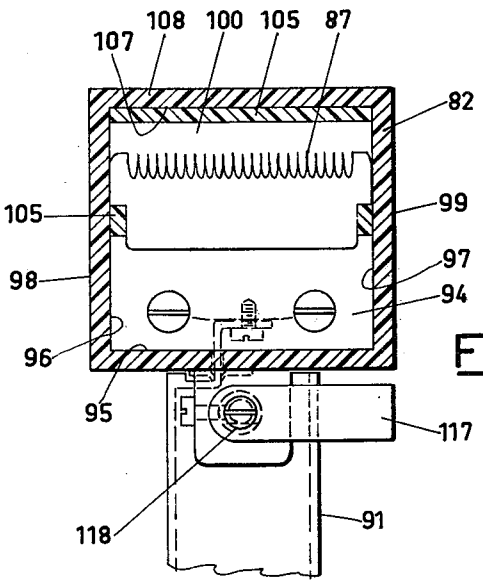
FIG. 15 is a transverse sectional view of the device shown in FIG. 14, taken on line 4—4, illustrating sealing against passage of air stream at locations other than directly through or above the cutting teeth.

Referring to FIGS. 14 and 15, a third preferred embodiment of a hair cutting and trimming device embodying the present invention is shown, generally indicated by numeral 80, comprises a tubular housing 82, having in this case a substantially rectangular cross-section, housing 82 having an open end 83 and an opposite closed end 84. A conventioal type motor drive hair clipper 85 has a cutting end 86, supplied with cutting teeth 87, clipper 85 being located, longitudinally slidable within housing 82, cutting teeth 87 being located toward open end 83.

A longitudinal slot 88 perforates one lower side 89 of an 82, a bracket 90, attached to clipper 85, extending through slot 88 to an external handle 91. Slot 88 is of a length sufficient to permit cutting teeth 87 of clipper 85 to be moved toward open end 83 of housing 82, and into close proximity thereof, to permit trimming of hair to a substantially short length, the length of slot 88 also permitting cutting teeth 87 to be moved away from open end 83 to a distance corresponding to the length of hair an operator may desire to cut to suit modern long hair styles such as for instance up to 10 inches or more.

The positioning of handle 91 longitudinaly along side 89 of housing 82 determines the position of clipper 85 with cutting teeth 87, within housing 82 and therefore governs the length of the hair that is being cut in that position, corresponding to the distance from open end 83 to cutting teeth 87.

Closed end 84 of housing 82 is supplied with hose connection means 92 for attachment to a source of suction, such as for instance a vacuum cleaner hose, connected to a vacuum cleaner to create suction within cavity 93 of housing 82. Cutting end 86 of clipper 85 is supplied with seal means 94 that fits closely against inner surface 95 of base of housing 82 and inner surfaces 96 and 97 of sides 98 and 99 respectively of housing 82. The suction means creates a vacuum in cavity 93 in housing 82, which draws in air from open end 83, toward cutting teeth 87 and through air channel 100, located directly over cutting teeth 87, air channel 100 and teeth 87 providing the only route for air to travel, since seal 94 prevents air from passing along base surface 95 and side surfaces 96 and 97.

In order to prevent hair 103 of scalp 104 from simply becoming located in channel 100, being drawn thereinto by the air stream without being cut by cutting teeth 87, a hair deflector means 105, generally similar to combination of 35 and 36 in FIG. 1 and for the same purpose, as explained previously in the text, is attached to forward end 106 of cutting end 86 of clipper 85, hair deflector means 105 providing a sliding air seal against inner surface 107 of upper wall 108 and side walls 98 and 99 of housing 82, hair deflector means 105 having a forward portion 110 depending down from surface 107, in front of cutting teeth 87, and a rearward nose portion 111 depending down from surface 107, behind cutting teeth 87, to provide substantial air stream passageway around teeth 87, yet at the same time forcing all hair 103, that is drawn toward channel 100 to be deflected into cutting teeth 87, to ensure that all hair reaching this area, is cut.

A rack 114, having journaled ends 115 is rotatably mounted in bearing blocks 116 attached to lower side 89 of housing 82, rack 114 being located substantially parallel to slot 88, one end of rack 114 being supplied with a handle 117 to facilitate rotation of rack 114 through approximately 90 degrees.

Rack 114 is supplied with a plurality of ratchet teeth 118 that face downwards, away from housing 82 in one position of handle 117, handle means 91 being supplied with an elongated trigger 119 that is attached to handle means 91, a short distance from inner extreme end 120 by pivot 121. Inner end 120 is located in close proximity of teeth 118 and has pivotally attached thereto a pawl 122 at pivot point 123, biased toward ratchet teeth 118 by spring 124.

A second pawl 125 is pivotally located on handle means 91 at 126 and biased toward ratchet teeth 118 by spring 127. Pawl 125 co-operates with pawl 122 to permit pawl 122 to jump forward one tooth upon trigger 119 being released, trigger 119 being pivotally attached to handle means 91 at 121 to provide moving handle means 121 at least one ratchet tooth upon trigger 119 being depressed, return spring 128 returning trigger 119 to its original position upon trigger 119 being released.

Rotating handle 117 through approximately 90 degrees causes ratchet teeth 118 to move out of engagement with pawls 122 and 125, to permit handle means 91 to be moved back against direction of ratchet teeth 118, whereafter rotating handle 117 back into its original position brings ratchet teeth 118 into engagement with pawls 122 and 125 again, ready to move handle means 91 forward upon trigger 119 being depressed.

Switch means 112 for operating cutter 85 may be located on power cord 113 as shown or on housing 82 as convenient.

Figure 16:
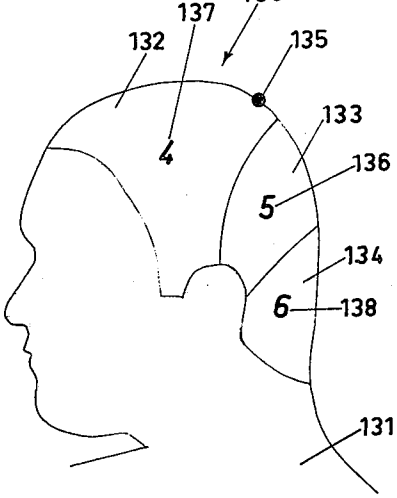
FIG. 16 illustrates method of providing programming means for utilization in conjunction with the present invention, showing in side elevation, a hair length map of a particular hair cutting hair style, each zone being marked with its own particular hair length.
Figure 17:
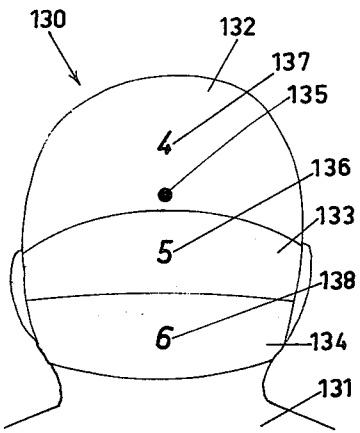
FIG. 17 is an example of an auxiliary mapped illustration of the style shown in FIG. 16, illustrating a view taken of the rear of the head, at an angle of approximately 450 degrees from the vertical, having zones marked corresponding to those on FIG. 16, FIG. 16 and FIG. 17 to be used in conjunction with a picture of the finished hair style.

Referring to FIGS. 16 and 17, a method of illustrative programming means is shown, included in this invention and to be used in conjunction with the hair cutting and trimming device embodying this invention.

FIG. 16 shows a side view of a potential haircut style, mapped out on scalp 130 of person 131, scalp 130 being, for ease of illustration in this case, divided into only three zones, 132, 133 and 134, though it is entirely feasible that illustrations of modern haircut styles could include a larger number of zones than shown in this particular illustration. A comparison mark 135 is included, representing substantially the center of scalp 130, the same comparison mark 135 being located on scalp 130 of FIG. 17, which contains a substantially plan view of the scalp 130, shown in FIG. 16, taken from the rear of the head at an angle of approximately 450degrees from the vertical, and marked with the same zones 132, 133 and 134, shown in FIG. 16, each zone being marked with an identifying figure such as shown at 136, 137 and 138, to correspond with previously explained distance settings on the tubular housing of this invention, to provide that hair within corresponding zones on the persons head is cut to correct lengths, to provide him with the particular hair style illustrated on the maps.

The side view and rear view maps shown may be accompanied by a photograph or drawing of the particular hair style, to facilitate choosing a hair style from a book containing a variety of hair styles, new books being issued as times and hair styles change.

It will be understood that although specific embodiments of the invention have herein been described and illustrated, the invention also contemplates variations in design and method as may hold within the scope of the appended claims.

I claim:

1. A hair cutting and trimming device comprising. an elongated, tubular housing having one open end and an opposite closed end, motor driven cutter means located within said housing, cutter blade means located at a forward end of said cutter means, means for supporting said cutter means axially of said housing, with said cutter forward end facing toward said open and of said housing, said cutter blade means being supplied with cutting teeth, said closed end of said housing being supplied with an opening, means for connecting said opening with a source of suction, said suction providing an air stream progressing from said open end, past said cutter blade means and towards said opening in said closed end, hair guide means located in said air stream, adjacent said cutting teeth, means for selectively varying the distance between said cutting teeth and said open end of said housing, hair length indicating means on said housing, a plurality of vacuum breaking slots located in rim of said open end, incremental control means for selective positioning of said cutting teeth relative to said open end, at least one suplementary extension tube detachably attachable to said open end of said housing, said extension tube having a free open end and a plurality of vacuum breaking slots in rim of said free open end, and descriptive hair style programing means co-operative with said means for selectively varying distance between said cutting teeth and said open end of said housing, said descriptive programming means containing illustrations of hair styles, supplied with a plurality of zones, each zone being marked to denote desired length of hair within said zone, said markings corresponding with said hair length indicating means on said housing.

2. A hair cutting and trimming device as claimed in claim 1, in which said cutter means, located within said housing, is attached substantially to one side of said housing, said housing being sufficiently larger in cross-section than said cutter means, to provide ample free cross-sectional area for said air stream to progress through, said cutter means being located in said housing so as to provide that said cutting teeth become located directly in said air stream, and slidable seal means at said forward end of said cutter means, between said cutter means and said housing, to prevent said air stream from passing by said forward end of said cutter means at locations other than in close proximity of said cutting teeth.

3. A hair cutting and trimming device as claimed in claim 1 in which said hair guide means comprises two separable sections, one being a stationary section, permanently attached in path of said air stream, between said cutting teeth and said closed end of said housing, said stationary section depending downward from inner surface of said housing, directly adjacent said cutting teeth and partway toward said cutter means, to force hair, that is drawn in through said open end, past said cutting teeth by said air stream, to be biased toward and into said cutting teeth and be cut, the other of said separable sections being a removable section of said hair guide means, detachably attached to said stationary section, said removable section being located in said air stream, between said open end of said housing and said cutting teeth, said removable section depending down in front of said cutting teeth, said removable section and said stationary section forming a curved, concave configuration over said cutting teeth to bias air stream and any hair located in said air stream above said cutting teeth towards and into said cutting teeth.

4. A hair cutting and trimming device as claimed in claim 1 in which said cutter blade means comprises a stationary cutter blade that completely fills the internal cross-sectional area of said housing, and a movable cutter blade juxtapositioned against said stationary cutter blade, said cutting teeth in said stationary blade comprising a plurality of adjacently positioned elongated slots, substantially perpendicular to direction of motion of said movable blade, said cutting teeth in said movable blade comprising a plurality of cutting slots located in a position corresponding to said cutting slots on said stationary blade, said cutting slots in said stationary blade and said cutting slots in said movable blade being located obliquely to each other to provide shearing action on hair that enters said cutting blade means during cutting operation, said motor driven cutter means having a reciprocating drive member supplied with pivot pin means having an axis perpendicular to direction of said reciprocating motion, spring yoke means having an eye formed substantially centrally of said spring yoke means, said eye being pivotably located on said pivot pin means, ends of said spring yoke means being attached at either side of said movable blade, said spring yoke means being adapted to transfer said reciprocating motion from said motor drive arm to said movable blade, and at the same time bias said movable blade toward said stationary blade, said hair guide means comprising plate means located in front of said stationary blade, said plate means having a truncated hole therethrough, a smaller end of said truncated hole being located directly over area of said stationary blade that contains said plurality of cutting slots, larger end of said truncated hole facing toward said open end of said housing.

5. A hair cutting and trimming device as claimed in claim 1 in which said means for selectively varying the distance between said cutting teeth and said open end of said housing comprises an external, telescopically slidable, extendable tube located axially around said housing, said extendable tube having an open end extending outwardly of said open end of said housing, said open end of said extendable tube having a rim containing a plurality of vacuum breaker slots, said housing being supplied externally with a plurality of incrementally spaced annular grooves, said extendable tube containing at least one, inwardly biased, spring loaded detent means, adapted to successively engage in said annular grooves upon said extendable tube being moved in and out upon said housing, said hair length indicating means comprising visual scale means on said housing co-operating with marker means on said extendable tube to visually express distance between said open end of said extendable tube and said cutting teeth.

6. A hair cutting and trimming device as claimed in claim 1, in which said tubular housing is of circular cross-section, said means for selectively varying the distance between said cutting teeth and said open end of said housing comprising an external, telescopically slidable, extendable tube, located around said housing, said extendable tube having an open end extending outward from said open end of said housing, said open end of said extendable tube having a rim containing a plurality of vacuum breaker slots, said tubular housing having a shallow thread located in its external cylindrical surface, said extendable tube containing at least one inwardly biased, spring loaded detent means, adapted to successively engage in said shallow threads upon said extendable tube being moved axially in and out upon said housing, said detent means acting as nut means for said extendable tube on said thread, upon said extendable tube being rotated on said housing, said hair length indicating means comprising visual scale means on said housing co-operating with marker means on said extendable tube, said hair guide means being supplied with at least one turbulence breaking tab means projecting partway into said airstream toward said cutting teeth.

7. A hair cutting and trimming device as claimed in claim 1, in which said means for supporting said cutter means comprises handle means attached to said cutter means, said handle means extending outward through elongated slot means in said tubular housing, flexible seal means being attached on either side of said slot, said flexible seal means being biased to ward each other and around said handle means to seal against loss of vacuum within said housing, said cutter means being axially moveable within said housing for the length of said slot, said handle means being penetrated by rack means supplied with ratchet teeth, said rack means being attached to said housing parallel to axial direction of said housing, manually operable trigger means on said handle means containing pawl means co-operable with pawl means on said handle means to engage with said ratchet teeth and move said handle means and said cutter means relative to said open end of said housing a distance of at least one ratchet tooth upon said trigger being depressed, and means for rotating said ratchet teeth on said rack out of engagement with said pawls to permit said cutter means and said handle means to be moved back in direction against said ratchet teeth.

* * * * *